United States Patent [19]

Kawata et al.

[11] Patent Number: 4,651,641

[45] Date of Patent: Mar. 24, 1987

[54] OFFSET ROTARY PRESS

[75] Inventors: Tomoshi Kawata, Yokohama; Kenji Kusunoki, Atsugi, both of Japan

[73] Assignee: Kabushiki Kaisha Tokyo Kikai Seisakusho, Tokyo, Japan

[21] Appl. No.: 828,636

[22] Filed: Feb. 11, 1986

[30] Foreign Application Priority Data

Feb. 12, 1985 [JP] Japan ..... 60-023393

[51] Int. Cl.[4] ..... B41F 5/22; B41F 7/12

[52] U.S. Cl. ..... 101/217; 101/220

[58] Field of Search ..... 101/179, 178, 180, 181, 101/177, 220, 221, 219, 216, 217, 218, 183, 184, 185, 248; 74/409, 440; 100/168

[56] References Cited

U.S. PATENT DOCUMENTS

| | | | |
|---|---|---|---|
| 2,937,591 | 5/1960 | Wagner | 101/248 X |
| 3,037,396 | 6/1962 | Martin | 101/248 X |
| 3,299,801 | 1/1967 | Bishop | 100/168 |
| 3,407,727 | 10/1968 | Fischer | 101/177 |
| 3,477,370 | 11/1969 | Fischer | 101/248 |
| 3,496,865 | 2/1970 | Fischer | 101/248 X |
| 3,742,849 | 7/1973 | Greiner et al. | 101/220 |

*Primary Examiner*—J. Reed Fisher

*Attorney, Agent, or Firm*—Frost & Jacobs

[57] ABSTRACT

The known offset rotary press of the type that at least a pair of printing cylinders consisting of a plate cylinder and a blanket cylinder are disposed in juxtaposition adjacent to each other, and that the adjacent plate and blanket cylinders are rotated at the same revolution speed in the opposite directions to each other through gears having the same pitch circle diameter and the same number of teeth, is improved in that in the case where one of the pair of printing cylinders having a slightly larger finished cylinder diameter than that of another printing cylinder is positioned upstream on the side of power transmission with respect to the printing cylinder having the smaller finished cylinder diameter, an intermediate gear connected to a drive source is rotatably mounted on a cylinder shaft of the printing cylinder having the larger finished cylinder diameter on which a first gear is fixedly mounted also, and in that the intermediate gear and the first gear are respectively meshed with a second gear fixedly mounted on a cylinder shaft of the printing cylinder having the smaller finished cylinder diameter.

3 Claims, 13 Drawing Figures

OFFSET ROTARY PRESS

BACKGROUND OF THE INVENTION

1. Field of the Invention

The present invention relates to an offset rotary press, and more particularly to a gear train arrangement for driving at least a pair of printing cylinders or rolls such as a plate cylinder or roll, a blanket cylinder or roll and the like in an offset rotary press.

2. Description of the Prior Art

The offset printing has it as a basic operation principle to effect printing by transferring patterns on a plate surface on to a blanket surface, and thereafter transferring the patterns transferred onto the blanket surface onto a surface of a paper.

In a heretofore known offset rotary press, for example, as shown in FIG. 1, a first plate cylinder or roll 1 having a plate mounted thereon, a first blanket cylinder or roll 2 having a blanket mounted thereon, a second blanket cylinder or roll 3 and a second plate cylinder or roll 4 are disposed succesively adjacent to each other. A paper 5 is fed between the first and the second blanket cylinders 2 and 3. The first plate cylinder 1, the first blanket cylinder 2, the second blanket cylinder 3 and the second plate cylinder 4 are respectively driven in such a manner that adjacent ones of these printing cylinder may be rotated in the opposite directions to each other at the same revolution speed, to effect printing.

With regard to a gear train arrangement for driving the above-mentioned respective printing cylinders, for example, as shown in FIG. 2, it has been known that helical gears 10, 11, 12 and 13 having the same pitch circle diameter and the same number of teeth are fixedly mounted as by keys not shown to cylinder shafts 6, 7, 8 and 9, respectively, of the respective printing cylinders so that the gears may mesh with each other, and that a bevel gear 14 is fixedly secured to one of the cylinder shafts, e.g., the cylinder shaft 6 in FIG. 2, to this bevel gear 14 is meshed another bevel gear 16 which is fixedly secured to a vertical drive shaft 15 connected to a drive source not shown, and thereby driving power is transmitted to the respective printing cylinders so that adjacent ones of the printing cylinders may rotate at the same revolution speed in the opposite directions to each other.

In other words, with regard to a gear train arrangement for driving printing cylinders in an offset rotary press, there is known such a gear train arrangement that power transmission is effected successively from an upstream side to a downstream side with respect to a drive source according to a sequence of array of printing cylinders in which a first printing cylinder firstly transmitted with power from the side of the drive source, that is, the first plate cylinder 1 in FIG. 2 is disposed on the most upstream side of the sequence of array of printing cylinders and subsequently the downstream sides are given to other printing cylinders in the sequence of adjacent disposals.

It is to be noted that while driving power could be transmitted from the side of the gear 13 by fixedly securing the bevel gear 14 to the cylinder shaft 9 of the second plate cylinder 4, it is not favourable and hence not practiced commonly to fixedly secure the bevel gear 14 to the cylinder shaft 7 or 8 of the first or second blanket cylinder 2 or 3, because the cylinder shafts 7 and 8 are moved upon cylinder trip ON/OFF when the contact between the respective printing cylinders is touched/released.

As described above, in an offset rotary press, a plate cylinder and an associated blanket are driven through gears so that they may be rotated at a revolution speed ratio of 1:1. Since gears are generally provided with a backlash so that their meshed rotation can be achieved smoothly, among the gears rotating in a meshed condition, if a gear on the driven side is subjected to any external force, then the driven gear can move freely by the amount corresponding to the above-mentioned backlash with respect to the gear on the driving side.

On the other hand, in an offset rotary press, it has been well known, for instance, in an equal diameter cylinder arrangement or in a true-rolling cylinder arrangement, to make a finished diameter of a plate cylinder, that is, a diameter including a printing plate which has been mounted on the plate cylinder and a finished diameter of a blanket cylinder, that is, a diameter involving a blanket which has been mounted on the blanket cylinder to be different from each other, though slightly.

Thus, when the plate cylinder and the blanket cylinder having slightly different finished cylinder diameters rotate in an associated rotating condition as a result of a contact pressure for transfer of patterns, the rotational angles of the plate cylinder and the blanket cylinder would differ from each other by a small amount because the circumferential lengths of the respective cylinders are different, and since these cylinders are rotated while forcibly correcting this difference by gear drive, a larger force would act on the gears.

Accordingly, in FIG. 2, in the case where the finished cylinder diameter of the first and second blanket cylinders 2 and 3 are slightly larger than those of the first and second plate cylinders 1 and 4, respectively, then since the first blanket cylinder 2 which rotates in an associated rotating condition with the first plate cylinder 1 tends to rotate more slowly than the first plate cylinder 1, a tooth surface 10*a* on the leading side in the direction of rotation of the gear 10 comes into press contact with a tooth surface 11*b* on the trailing side in the direction of rotation of the gear 11 as shown in FIG. 3, whereas since the second plate cylinder 4, which is rotated in an associated rotating condition with the second blanket cylinder 3, tends to rotate faster than the second blanket cylinder 3, a tooth surface 13*a* on the leading side in the direction of rotation of the gear 13 comes into press contact with a tooth surface 12*b* on the trailing side in the direction of rotation of the gear 12 as shown in FIG. 4, thereby the rotation of the second plate cylinder 4 is constrained by the gear 13 and the gear 12 to forcibly correct the difference in a rotational angle between the printing cylinders 3 and 4, and the second plate cylinder 4 would rotate as advancing by the amount corresponding to the backlash S of the gear 13.

In other words, in the case where among adjacent printing cylinders, a printing cylinder having a larger finished cylinder diameter is positioned on the upstream side of the drive source with respect to another printing cylinder having a smaller finished cylinder diameter the other printing cylinder would rotate as advancing by the amount corresponding to the backlash of the gear.

However, rotation of a printing cylinder in an associated rotating condition caused by a contact pressure between printing cylinders lacks definiteness, because the rotation may be possibly varied even by momentary change of the contact pressure, and so a printing cylinder having a smaller finished cylinder diameter, that is, the second plate cylinder 4 in FIG. 2 would rotate as arbitrarily changing its position in the range corresponding to the backlash wherein forcibly correction by the gear is ineffective.

More particularly, if a torque causing associated rotation of the second plate cylinder 4 becomes small as a result of variation of the contact pressure, then the situation is changed in such a manner that a tooth surface 12*a* on the leading side in the direction of rotation of the gear 12 in FIG. 2 which is a driving gear and a tooth surface 13*b* on the trailing side in the direction of rotation of the gear 13 in FIG. 2 which is a driven gear would come into press contact with each other, and hence the second plate cylinder 4 is rotated by the driving gear, and therefore the second plate cylinder 4 can rotate freely by the amount corresponding to the backlash of the gear 13.

From the above-mentioned reasons, the contact positions of the printing cylinders, which rotate in contact with each other, necessarily lose definiteness, hence upon transfer of patterns from the plate surface to the blanket surface, deviation would arise in the circumferential direction of the blanket cylinder between previously transferred patterns remaining on the blanket surface and newly transferred patterns, and accordingly there was a problem that upon transfer from the blanket surface to a surface of a paper, the two previous and new patterns deviating from each other on the blanket surface would be printed in the form of doubled patterns.

SUMMARY OF THE INVENTION

It is one object of the present invention to provide an offset rotary press in which doubled printing caused by a backlash in a gear train arrangement for driving printing cylinders can be prevented, and thereby printing quality can be greatly improved.

Another object of the present invention is to provide an offset rotary press having a novel gear train arrangement for driving printing cylinders which can eliminate deviation of patterns upon transfer from a plate surface of a plate cylinder to a blanket surface of a blanket cylinder caused by a backlash in a driving gear train.

In order to achieve the above-mentioned objects, according to the present invention, there is provided an offset rotary press of the type having at least a pair of printing cylinders comprising a plate cylinder having a printing plate mounted thereon and a blanket cylinder having a blanket mounted thereon are disposed in juxtaposition adjacent to each other wherein the adjacent plate and blanket cylinders of the pair of printing cylinders are rotated at the same revolution speed in opposite directions to each other through gears having the same pitch circle diameter and the same number of teeth, wherein patterns on a surface of said printing plate are transferred onto a surface of said blanket under the condition such that finished cylinder diameters of the adjacent plate and blanket cylinders are made to be slightly different from each other, and thereafter the patterns transferred onto the blanket surface are further transferred onto a surface of a paper to be printed thereon, the improvement wherein there is provided a gear train arrangement for driving the printing cylinders comprising an intermediate gear operatively connected to a drive source, wherein the intermediate gear is rotatably mounted on a first cylinder shaft of one of the pair of printing cylinders which has a larger finished cylinder diameter and is positioned upstream on the side of the drive source with respect to another cylinder of the pair of printing cylinders which has a smaller finished cylinder diameter, the first cylinder shaft fixedly mounting thereon a first gear, and wherein the intermediate gear and the first gear are respectively meshed with a second gear fixedly mounted on a second cylinder shaft of the cylinder having the smaller finished cylinder diameter.

According to one feature of the present invention, the above-described second gear has a width substantially corresponding to at least the total width of both of the intermediate gear and the first gear means.

According to an alteration of the present invention, the second gear comprises two gears separated from each other and fixedly secured to the second cylinder shaft, the separated gears having widths substantially corresponding to those of the intermediate gear and the first gear, respectively.

According to the present invention, owing to the above-described construction of the gear train arrangement for driving the printing cylinders, the second gear is driven by the drive source via the intermediate gear, also the first gear which tends to rotate more slowly than the second gear due to the associated rotation of the printing cylinders having different finished cylinder diameters, is driven by the second gear, and therefore the opposite tooth surfaces of the second gear are constrained by the intermediate gear and the first gear. Hence, even if a contact pressure between the adjacent printing cylinders should change, the printing cylinder having the smaller finished cylinder diameter could not change its position freely by the amount corresponding to a backlash in the driving gear train. Accordingly, deviation of patterns would not occur upon transfer thereof from the plate surface of the plate cylinder to the blanket surface of the blanket cylinder, hence loss of papers to be printed caused by double printing can be eliminated and also printing quality can be greatly improved.

DESCRIPTION OF THE PREFERRED EMBODIMENTS

Figure 1:
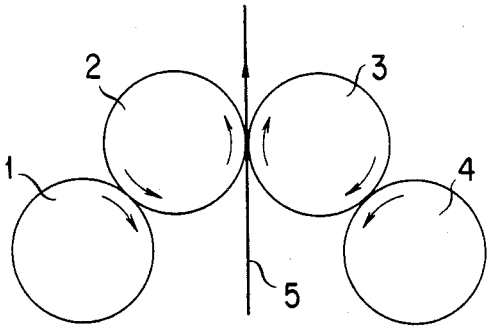
FIG. 1 PRIOR ART
FIG. 1 is a schematic, diagramatic view showing an arrangement of printing cylinders in an offset rotary press in the prior art.
Figure 2:
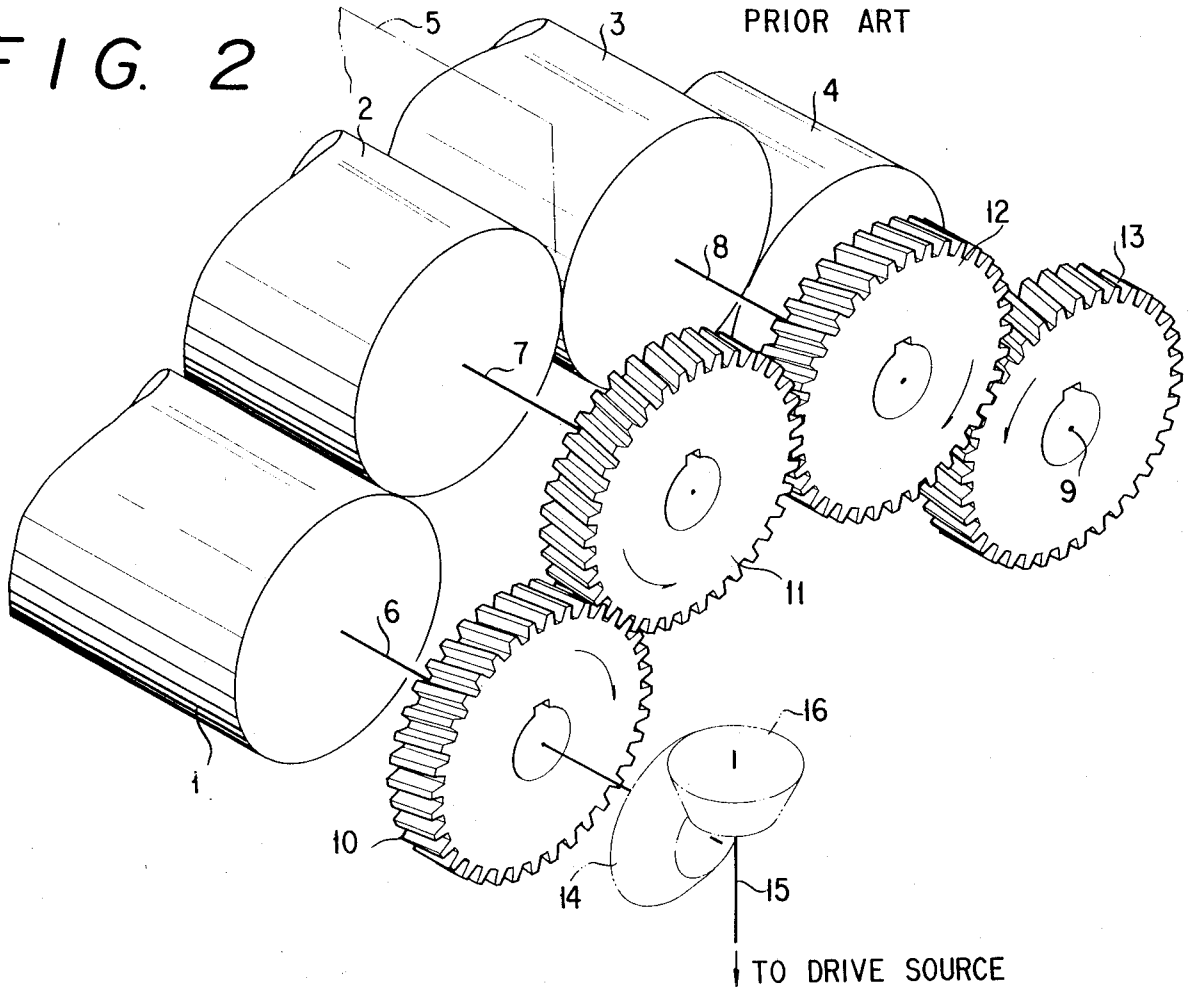
FIG. 2 is a schematic perspective view showing a gear train arrangement for driving printing cylinders in an offset rotary press in the prior art.
Figure 3:
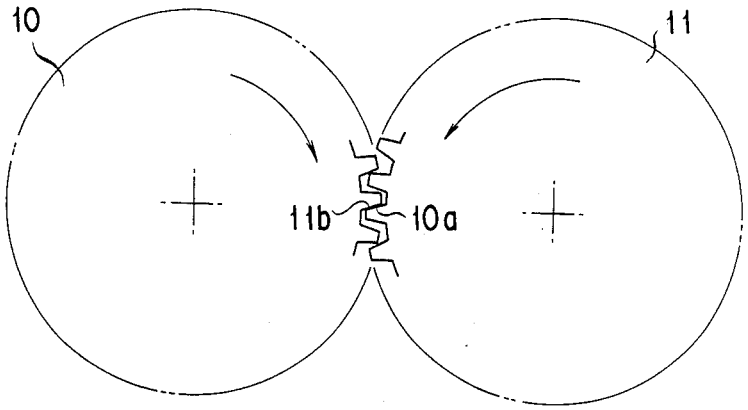
FIG. 3 PRIOR ART
FIGS. 3 and 4 are schematic front views respectively showing meshing states between pairs of adjacent gears in FIG. 2.
Figure 4:
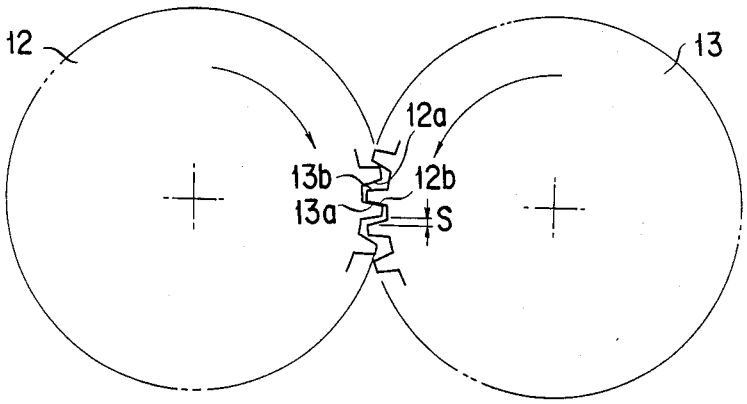
FIG. 4 PRIOR ART
Figure 5:
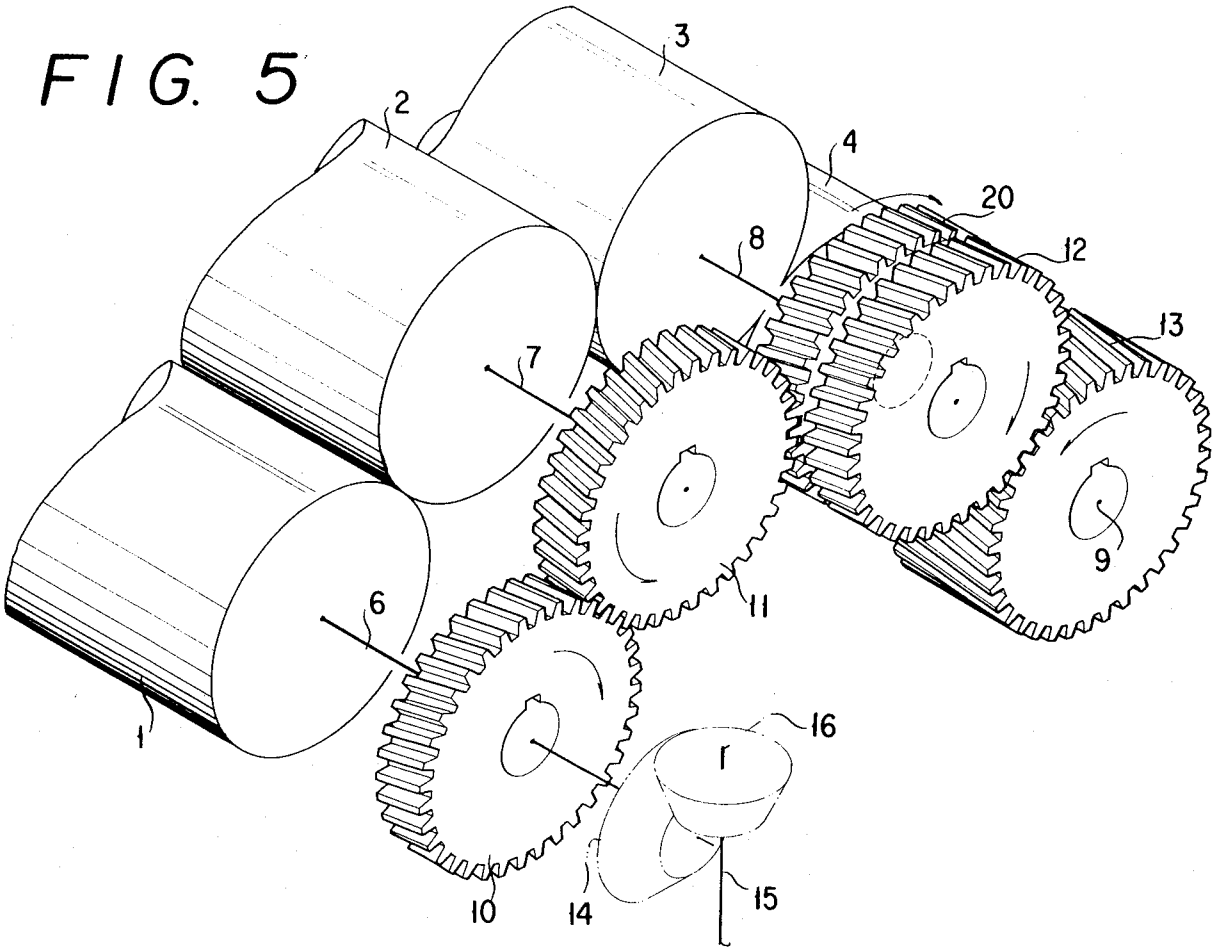
FIG. 5 is a schematic perspective view showing a first embodiment of a gear train arrangement for driving printing cylinders in an offset rotary press of the present invention.

Reference is now made to FIG. 5 of the accompanying drawings, a first preferred embodiment of the present invention is illustrated in a schematic perspective view, in which components members or parts identical to those used in an offset rotary press in the prior art shown in FIG. 2 and described above are given like reference numerals, and further detailed description thereof will be omitted.

In the first embodiment of a gear train arrangement for driving printing cylinders shown in FIG. 5, an intermediate gear 20 is rotatably mounted on a cylinder shaft 8 of a second blanket cylinder 3, also a first gear 12 is fixedly mounted on the same cylinder shaft 8. The intermediate gear 20 is meshed with a gear 11 and a second gear 13 at both sides thereof. The second gear 13 is fixedly mounted on a cylinder shaft 9 of a second plate cylinder 4 and formed to have a wide width corresponding to at least the total width of both of the intermediate gear 20 and the first gear 12, and the second gear 13 is also meshed with the first gear 12.

Thus, a gear train arrangement for driving a pair of printing cylinders consisting of the second plate cylinder 4 and the second blanket cylinder 3 is constituted. Another pair of printing cylinders consisting of a first plate cylinder 1 and a first blanket cylinder 2 are drived by a gear train of a gear 10 fixedly mounted on a cylinder shaft 6 connected to a drive source and the aforesaid gear 11 meshed with the gear 10 and the intermediate gear 20.

It is to be noted that the finished cylinder diameters of the first and second blanket cylinders 2 and 3 is made to be slightly larger than those of the first and second plate cylinders 1 and 4.

Figure 6:
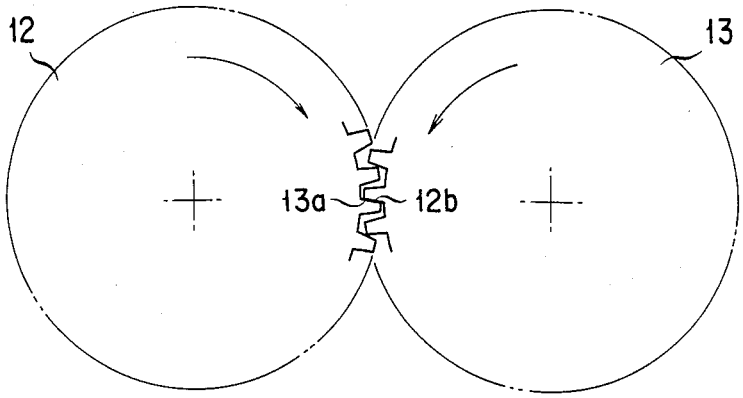
FIGS. 6 and 7 are schematic front views respectively showing meshing states between pairs of adjacent gears in FIG. 5.

Since the gear train arrangement for driving the printing cylinders is constructed as described above, driving power is transmitted from the gear 10 via the gear 11 and the intermediate gear 20 to the second gear 13, in turn, and the power is further transmitted from the gear 13 to the gear 12. Therefore, the meshing state between the gear 12 and the gear 13 is such that a tooth surface 12*b* on the trailing side in the direction of rotation of the gear 12 comes into press contact with a tooth surface 13*a* on the leading side in the direction of rotation of the gear 13 and thereby power is transmitted from the gear 13 to the gear 12 as shown in FIG. 6 because the second plate cylinder 4 tends to rotate faster than the second blanket cylinder 3. Hence, even if a contact pressure between the second blanket cylinder 3 and the second plate cylinder 4 should change momentarily, resulting in reduction of a torque caused by the associated rotation of the second plate cylinder 4 with the second blanket cylinder 3, the gear 13 would not freely change its position by the amount corresponding to a backlash because a torque is continuously transmitted via the intermediate gear 20.

Figure 7:
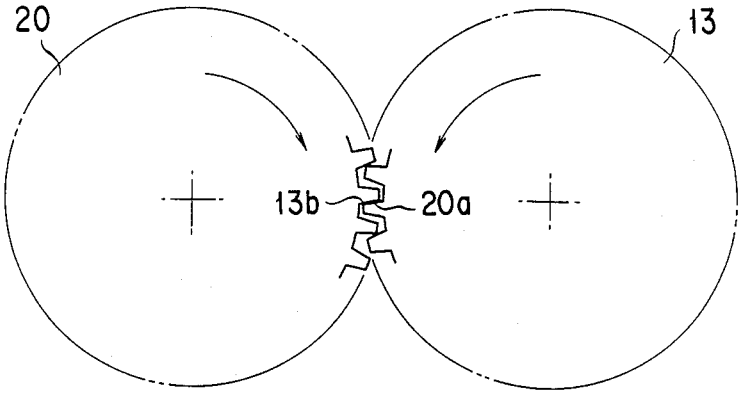

In addition, since the intermediate gear 20 is rotatable with respect to the cylinder shaft 8 and is driven by the gear 11 independently of the rotation of the second blanket cylinder 3 and also it meshes with the gear 13, the meshing state between the intermediate gear 20 and the gear 13 is such that a tooth surface 20*a* on the leading side in the direction of rotation of the intermediate gear 20 pushes a tooth surface 13*b* on the trailing side in the direction of rotation of the gear 13 to rotate the latter gear as shown in FIG. 7.

Accordingly, the gear 13 is rotating with both its tooth surface 13*a* on the leading side in the direction of rotation thereof and its tooth surface 13*b* on the trailing side in the direction of rotation thereof constrained simultaneously by the two gears consisting of the intermediate gear 20 and the gear 12 fixedly mounted on the same cylinder shaft 8, hence the rotation is equivalent to meshing rotation substantially without any backlash, and so, even if a contact pressure between the second blanket cylinder 3 and the second plate cylinder 4 should change, the second plate cylinder 4 having the smaller finished cylinder diameter would not freely change its position during rotation. As a result, indefiniteness of a contact position between the printing cylinders can be cleared out, and thereby doubled printing can be obviated.

It is to be noted also that in the case where the cylinder shaft 9 initially receives power transmission from a vertical drive shaft 15, it is only necessary to modify the above-described gear train arrangement for driving the printing cylinders in such a manner that the intermediate gear 20 is rotatably mounted on the cylinder shaft 7 of the first blanket cylinder 2, the gear 10 fixedly mounted on the cylinder shaft 6 of the first plate cylinder 1 is formed to have a wide width which corresponds to at least the total width of both of the intermediate gear 20 and the gear 11 so that the gear 10 meshes with the latter two gears.

Figure 8:
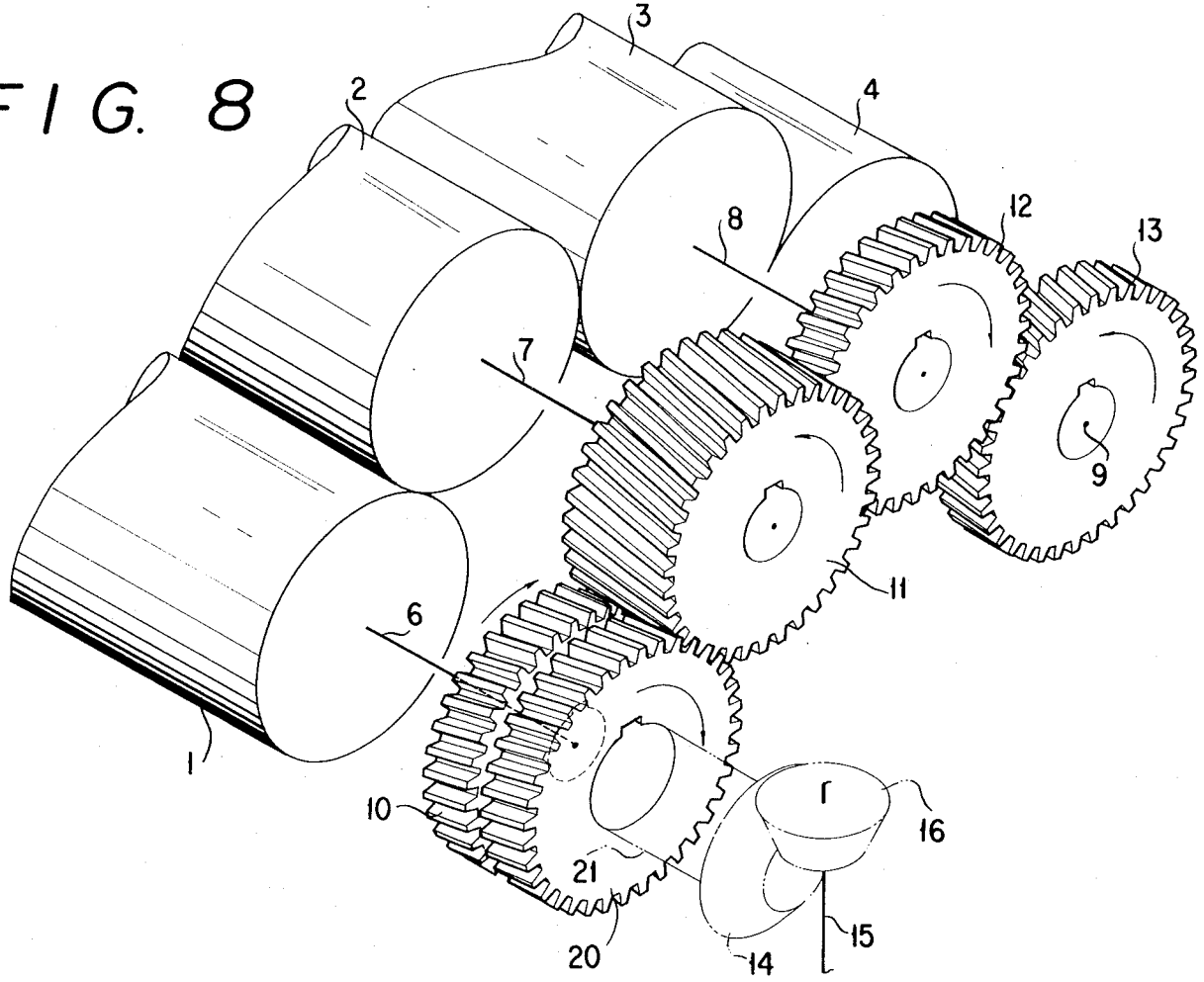
FIG. 8 is a schematic perspective view showing a second embodiment of a gear train arrangement for driving printing cylinders in an offset rotary press of the present invention.

On the contrary, in the event that the finished cylinder diameters of the first and second plate cylinders 1 and 4 are slightly larger than those of the first and second blanket cylinders 2 and 3, the gear train arrangement could be modified in such a manner that a bevel gear shaft 21 fixedly connected to a driven bevel gear 14 is rotatably mounted on the cylinder shaft 6 on which the gear 10 is fixedly mounted, the intermediate gear 20 is fixedly mounted on the bevel gear shaft 21, and the gear 10 and the intermediate gear 20 are meshed with a gear 11 fixedly mounted on the cylinder shaft 7 and having a wide width which corresponds to at least the total width of both of the gear 10 and the intermediate gear 20, thereby the gear 11 is rotationally driven by the intermediate gear 20, while the gear 10 is driven by the gear 11, as shown in FIG. 8.

Figure 9:
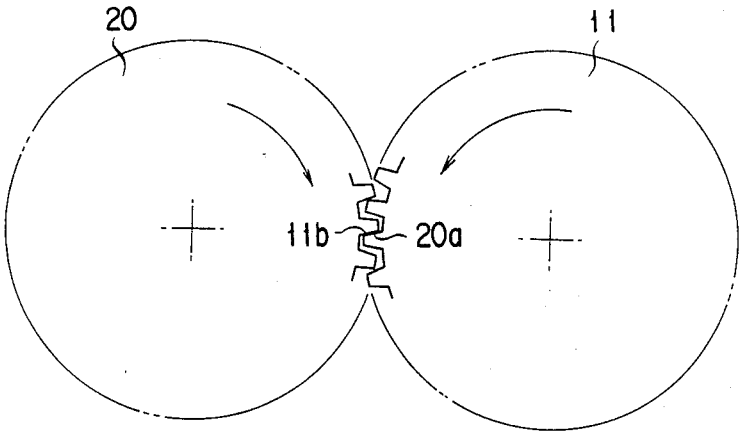
FIGS. 9 and 10 are schematic front views respectively showing meshing states between pairs of adjacent gears in FIG. 8.
Figure 10:
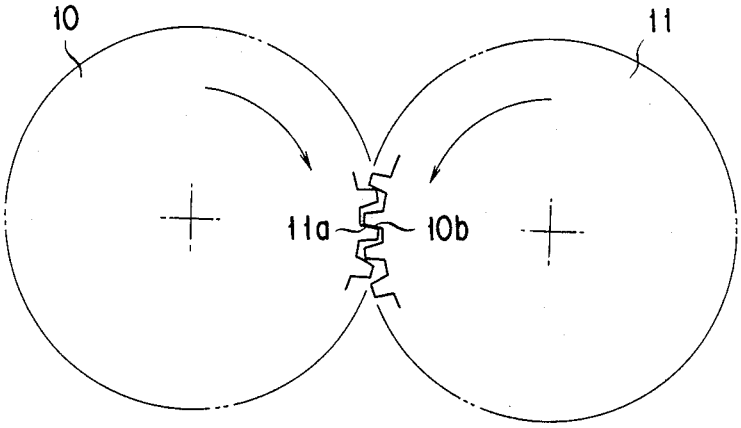

If the gear train arrangement for driving the printing cylinders is constructed as described above, a tooth surface 20*a* on the leading side in the direction of rotation of the intermediate gear 20 comes into press contact with a tooth surface 11*b* on the trailing side in the direction of rotation of the gear 11 as shown in FIG. 9, and on the other hand a tooth surface 10*b* on the trailing side in the direction of rotation of the gear 10 comes into press contact with a tooth surface 11*a* on the leading side in the direction of rotation of the gear 11 as shown in FIG. 10. Therefore, similarly to the first described case with reference to FIG. 5, both the tooth surface 11*a* on the leading side in the direction of rotation of the gear 11 and the tooth surface 11*b* on the trailing side in the direction of rotation thereof can be simultaneously constrained, and hence even if the contact pressure between the first plate cylinder 1 and the first blanket cylinder 2 should change, the first blanket cylinder 2 having a smaller finished cylinder diameter could not be freely changed in position by the amount corresponding to a backlash of the gear 11.

In other words, in the case where the first printing cylinder having a larger finished cylinder diameter is positioned on the upstream side of the drive source with respect to power transmission than the second printing cylinder having a smaller finished cylinder diameter, it is only necessary to construct the gear train arrangement in such a manner that an intermediate gear is rotatably mounted on a cylinder shaft of the first printing cylinder, the intermediate gear is meshed with a gear fixedly mounted on a cylinder shaft of the second printing cylinder to transmit driving power to the second printing cylinder, and the gear fixedly mounted on the second printing cylinder shaft is meshed with another gear fixedly mounted on the cylinder shaft of the first printing cylinder to transmit driving power to the first printing cylinder.

Figure 11:
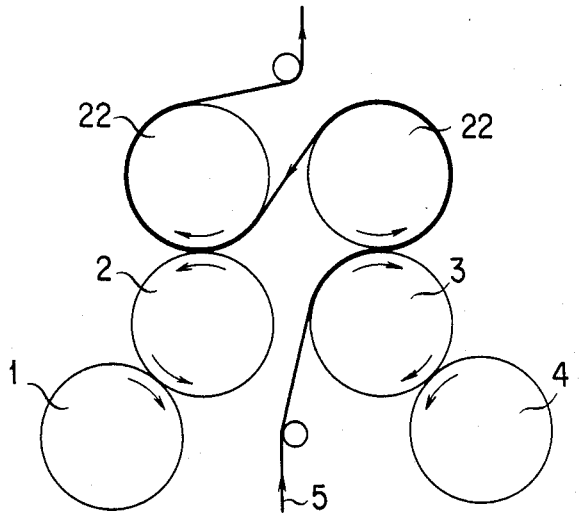
FIGS. 11 and 12 are schematic, diagramatic views showing different types of arrangements of printing cylinders in offset rotary presses.
Figure 12:
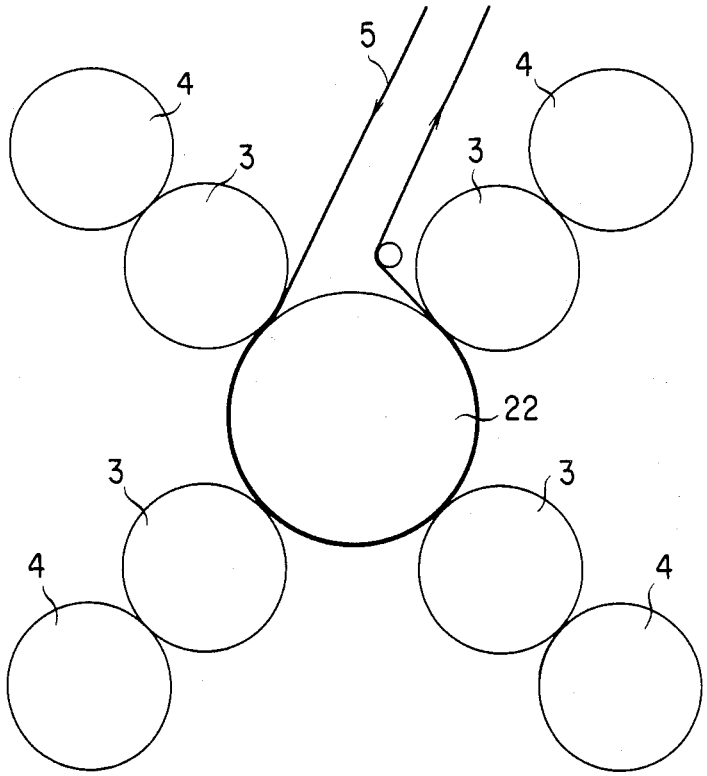

In addition, in the case of an offset rotary press in which pressure cylinders 22 are brought into press contact with the first and second blanket cylinders 2 and 3 as shown in FIG. 11, the method of power transmission as explained above in connection with the first or second preferred embodiment could be practiced depending upon the position where driving power is input and the finished cylinder diameters of the blanket cylinder and the plate cylinder, whereas in the case of an offset rotary press in which a plurality of blanket cylinders are brought into press contact with a single pressure cylinder 22 as shown FIG. 12, since driving power is normally input of the pressure cylinder 22, in the case where the finished cylinder diameter of the blanket cylinder is larger, the method of power transmission as explained in connection with the first preferred embodiment could be practiced.

Figure 13:
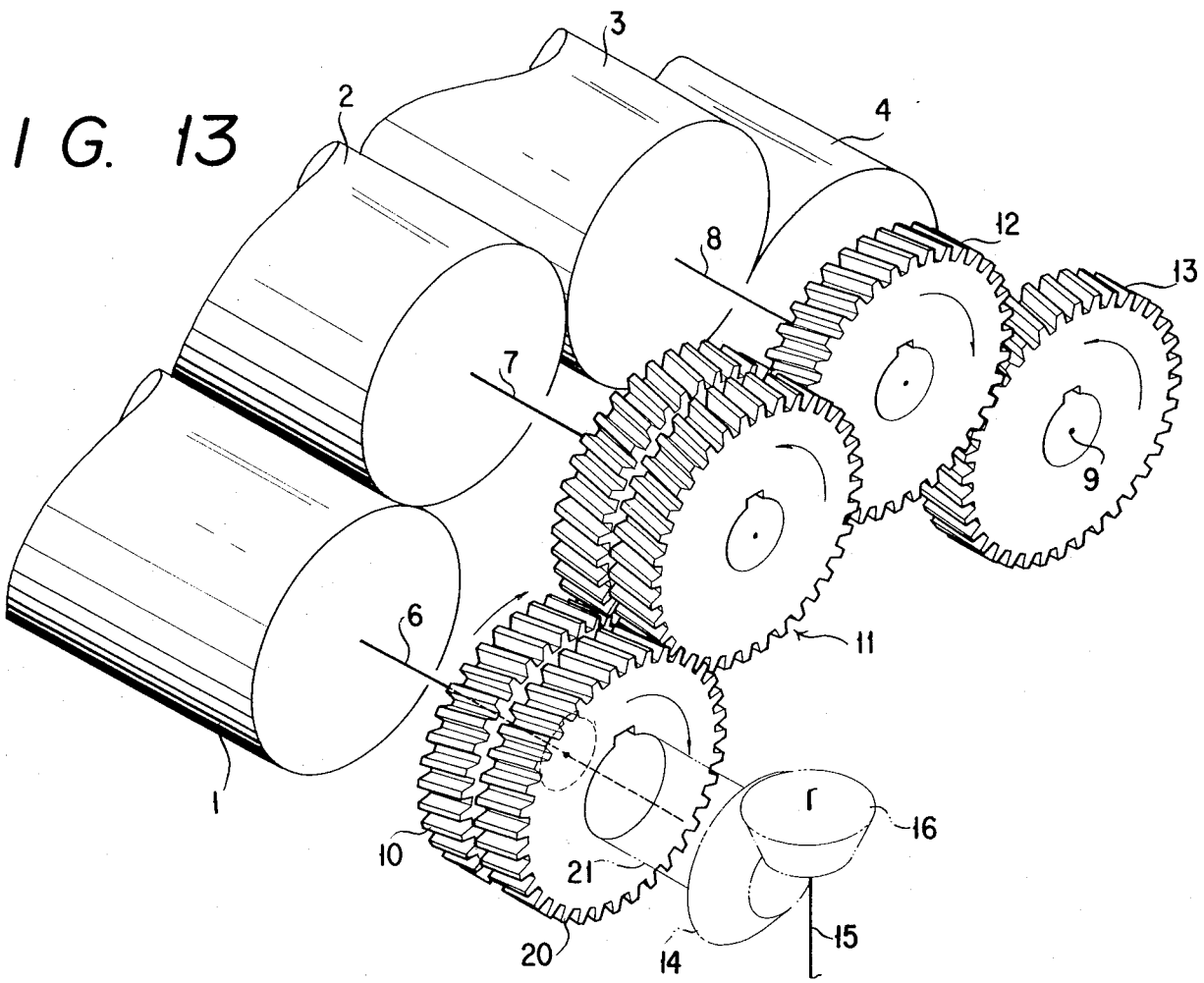
FIG. 13 is a schematic perspective view showing a third embodiment of a gear train arrangement for driving printing cylinders in an offset rotary press of the present invention.

It is to be noted that the gear 13 having a wide width in FIG. 5 and the gear 11 having a wide width in FIG. 8 could be formed of two narrow width gears separated from each other and each having the substantially same width so that of the gear 10, 12 or 20 as shown in FIG. 13, and the separated gears could be fixedly mounted to the cylinder shaft 9 or 7 as by key, bolt, etc.

As will be apparent from the foregoing description, according to the present invention, a second gear fixedly mounted on a second cylinder shaft of one of a pair of printing cylinders which has a smaller finished cylinder diameter and is positioned on the downstream side of a drive source with respect to power transmission than another printing cylinder having a larger finished cylinder diameter and positioned on the upstream side of the drive source with respect to power transmission is driven through an intermediate gear rotatably mounted on a first cylinder shaft on which the printing cylinder having the larger finished cylinder diameter is fixedly mounted, and a first gear fixedly mounted on the first cylinder shaft is driven by the second gear, so that opposite tooth surfaces of a tooth of the second gear are simultaneously constrained by the intermediate gear and the first gear, and therefore even if a contact pressure between the pair of adjacent printing cylinders should change, the printing cylinder having the smaller finished cylinder diameter would not freely change in position by the amount corresponding to a backlash of the gears.

Accordingly, deviation of patterns to be printed would not occur upon transfer of the patterns from a plate surface of a plate cylinder to a blanket surface of a blanket cylinder, and so, not only loss of papers caused by doubled printing can be eliminated, but also great improvement in printing quality can be achieved.

While a principle of the present invention has been described above in connection with preferred embodiments of the invention, it is intended that all matter contained in the foregoing description and illustrated in the accompanying drawings shall be interpreted to be illustrative and not in a limiting sense.

What is claimed is:

1. In an offset rotary press of the type having at least a pair of printing cylinders comprising a plate cylinder having a printing plate mounted thereon and a blanket cylinder having a blanket mounted thereon disposed in juxtaposition adjacent to each other wherein the adjacent plate and blanket cylinders of the pair of printing cylinders are rotated at the same revolution speed in opposite directions to each other through gears having the same pitch circle diameter and the same number of teeth, wherein patterns on a surface of said printing plate are transferred onto a surface of said blanket under the condition such that finished cylinder diameters of said adjacent plate and blanket cylinders are made to be slightly different from each other, and thereafter said patterns transferred onto said blanket surface are further transferred onto a surface of a paper to be printed thereon, the improvement wherein there is provided a gear train arrangement for driving said printing cylinders comprising an intermediate gear means operatively connected to a drive source, wherein said intermediate gear means is rotatably mounted on a first cylinder shaft of one of the pair of printing cylinders which has a larger finished cylinder diameter and is positioned upstream on the side of the drive source with respect to another cylinder of the pair of printing cylinders which has a smaller finished cylinder diameter, said first cylinder shaft fixedly mounting thereon a first gear means, and wherein said intermediate gear means and said first gear means are respectively meshed with a second gear means fixedly mounted on a second cylinder shaft of said another cylinder having the smaller finished cylinder diameter.

2. The improvement claimed in claim 4, wherein said second gear means comprises a gear having a wide width which corresponds to at least the total width of both of said intermediate gear means and said first gear means.

3. The improvement claimed in claim 4, wherein said second gear means comprises two gears separated from each other and fixedly secured to said second cylinder shaft, said gears having widths substantially corresponding to those of said intermediate gear means and said first gear means, respectively.

* * * * *